US005478266A

United States Patent [19]

Kelly

[11] Patent Number: 5,478,266

[45] Date of Patent: Dec. 26, 1995

[54] BEAM WINDOW DEVICES AND METHODS OF MAKING SAME

[75] Inventor: Arnold J. Kelly, Princeton Junction, N.J.

[73] Assignee: Charged Injection Corporation, Monmouth Junction, N.J.

[21] Appl. No.: 163,888

[22] Filed: Dec. 8, 1993

Related U.S. Application Data

[63] Continuation-in-part of Ser. No. 45,942, Apr. 12, 1993, Pat. No. 5,391,958.

[51] Int. Cl.[6] ..... H01J 9/40

[52] U.S. Cl. ..... 445/43; 445/44

[58] Field of Search ..... 445/28, 43, 44

[56] References Cited

U.S. PATENT DOCUMENTS

| | | | |
|---|---|---|---|
| 2,990,493 | 6/1961 | Seehof et al. . | |
| 3,105,916 | 10/1963 | Marker et al. . | |
| 3,211,937 | 10/1965 | Hester et al. . | |
| 3,256,455 | 6/1966 | Saldi | 445/44 |
| 3,406,304 | 10/1968 | Brewster . | |
| 3,531,340 | 9/1970 | Bunshah et al. . | |
| 3,788,892 | 5/1970 | Van Raalte et al. . | |
| 4,222,815 | 9/1980 | Krechmery . | |
| 4,333,036 | 6/1982 | Farrell . | |
| 4,362,965 | 12/1982 | Kendall . | |
| 4,468,282 | 8/1984 | Neukermans . | |
| 4,494,036 | 1/1985 | Neukermans . | |
| 4,523,974 | 6/1985 | Duly et al. . | |
| 4,591,756 | 5/1986 | Avnery . | |
| 4,680,243 | 7/1987 | Shimkunas et al. . | |
| 4,721,967 | 1/1988 | Roche . | |
| 4,775,347 | 10/1988 | Takada et al. | 445/44 |
| 5,030,318 | 7/1991 | Reche . | |

FOREIGN PATENT DOCUMENTS

| | | |
|---|---|---|
| 5025599 | of 1975 | Japan . |
| 50-25599 | 3/1975 | Japan . |
| 2138900 | of 1990 | Japan . |
| 2-138900 | 5/1990 | Japan . |
| 788299 | 1/1955 | United Kingdom . |
| 1206623 | 9/1967 | United Kingdom . |
| 1195756 | 11/1968 | United Kingdom . |

*Primary Examiner*—P. Austin Bradley
*Assistant Examiner*—Jeffrey T. Knapp
*Attorney, Agent, or Firm*—Lerner, David, Littenberg, Krumholz & Mentlik

[57] ABSTRACT

A beam tube having a hole or "window" covered by a thin, beam permeable membrane is provided with a polymeric ring for minimizing stress concentration in the membrane adjacent the periphery of the hole to relieve stress concentrations that would otherwise occur when the membrane is forced inwardly into the hole by atmospheric or other pressure on the exterior of the tube. The exterior surface of the housing for the beam tube contains means for retaining the polymeric ring in a predetermined location on the exterior surface. The retaining means which retain the polymeric material away from the hole may comprise an annular channel formed in the exterior surface of the front wall, an annular raised inner ridge formed on the exterior surface, an annular raised outer ridge also formed on the exterior surface to define an annular track between the outer and inner ridges, or a ring of flow preventing material on the exterior surface of the housing. In a manufacturing method, a liquid polymer precursor is placed on the exterior surface of the front wall and retained by the retaining means when the membrane, precursor and housing are heated to an elevated bonding temperature so as to cure the polymer precursor to form the polymeric ring retained by the retaining means away from the hole during the bonding step.

13 Claims, 3 Drawing Sheets

BEAM WINDOW DEVICES AND METHODS OF MAKING SAME

CROSS-REFERENCE TO RELATED APPLICATIONS

This application is a continuation-in-part of application U.S. Ser. No. 08/045,942, filed Apr. 12, 1993, now U.S. Pat. No. 5,391,958, the disclosure of which is hereby incorporated by reference herein.

FIELD OF THE INVENTION

The present invention relates to beam tubes having a housing with an aperture or "window" in the wall of the housing so that the beam may pass out of the housing, and to methods of making such tubes and components thereof.

BACKGROUND OF THE INVENTION

Beam apparatus typically includes a hollow housing and a "gun" or source of energetic electrons or electromagnetic radiation such as X-rays mounted within the housing. The interior or the housing is maintained under vacuum so as to facilitate generation and direction of the beam. In many types of electron beam devices, for example, the electron beam does not pass out of the housing. For example, in a common cathode ray tube, the beam acts only on a phosphor inside the housing to produce visible light, which in turn is transmitted through a transparent wall of the housing. Likewise, in certain electron beam material treatment apparatus, such as electron beam welding devices and the like, the workpiece to be treated by the electron beam is placed into the housing and the housing is then evacuated before operation.

Other types of beam apparatus require that the beam pass out of the tube housing. The electron tube housing is provided with an aperture or "window" for passage of the electron beam, so that the beam can be directed on a workpiece positioned outside of the housing. For example, in electron beam sterilization and chemical curing processes, an item to be treated is positioned outside of the housing in front of the window and treated by the beam. In electron beam printing processes, a document to be printed is positioned outside of the housing, in front of the window, and treated with an electron beam so as to apply an electrical charge on the document in a manner corresponding to the pattern of the desired printing. My own U.S. Pat. No. 5,093,602 and PCT International Publication No. WO/91/07772 disclose methods and devices in which an electron beam is used to promote dispersion of a fluent material such as a liquid, slurry or gas-borne powder. In this arrangement, the electron beam is generated inside an evacuated housing and passes out of the housing through an opening or window so that the beam impinges upon the fluent material.

The opening or window in the electron tube housing must be covered with a membrane which permits passage of the electron beam to the outside of the housing, but which blocks passage of air or other fluids into the housing so as to preserve the vacuum within the housing. For example, in fluid dispension methods according to the aforementioned patent and application, the fluid typically is at atmospheric or superatmospheric pressure. Thus, the membrane must allow passage of the electron beam out of the tube and into the fluid while isolating the interior of the housing from the fluid.

Membranes utilized for passage of an X-ray or electron beam must meet numerous conflicting requirements. The "beam-permeable" membrane must have relatively low absorption for the X-rays or electrons so that the beam passes through the membrane with little attenuation. As used herein, the term "beam permeable" refers to the allowance of electrons or electromagnetic radiation such as X-rays to pass through a given object, and here in particular, a membrane. This is significant both with respect to the power remaining in the beam and with respect to possible effects of the beam on the membrane itself. Thus, in electron beam applications where the membrane absorbs a substantial fraction of the electrons in the beam, the energy imparted by the electrons may heat the membrane to an unacceptable degree or otherwise destroy the membrane. The requirement for low absorption leads to a strong preference for very thin membranes formed from materials having inherently low electron absorptivity, typically materials formed from elements having low atomic number. The membrane must provide an effective barrier against entry of atmospheric or other materials into the interior of the tube housing. It should be substantially impermeable to common gases and liquids, and must have sufficient physical strength to resist differential pressure encountered in service. As the interior of the housing is maintained substantially under vacuum, the differential pressure applied to the membrane is substantially equal to the absolute pressure prevailing on the outside of the housing in the vicinity of the membrane. Where the exterior surface of the membrane is exposed to a fluent material under superatmospheric pressure, high differential pressures are encountered. The differential pressure causes considerable stress in the membrane. Moreover, the fluid pressure may fluctuate, and hence the stress applied to the membrane may be a fluctuating stress. These factors require that the membrane have considerable mechanical strength.

Further, the tube housing may be subjected to substantial temperature changes during manufacture and service. It is normally necessary to subject an electron tube to a so-called "bakeout" treatment at elevated temperature during manufacture. Typically, the bakeout procedure is conducted after the electronic components of the tube such as electrodes, coils and the like have been mounted inside of the housing but before the housing has been fully sealed. The elevated temperature drives off volatile materials from the inside of the housing and from the electronic components. The heating and cooling which occurs during the bakeout process can induce significant thermal expansion and contraction of the membrane and housing, leading to still further stresses. The magnitude of such stresses is directly proportional to the difference between the coefficients of thermal expansion of the membrane material and the coefficient of thermal expansion of the adjacent housing material.

All of these factors taken together present a significant technical challenge. Moreover, in many applications the cost of the electron tube structure is of significance.

Considerable effort has been devoted in the art to the search for an electron tube structure and methods of making electron tubes which satisfy the foregoing considerations. Neukermans, U.S. Pat. No. 4,468,282 discloses an electron beam window structure and methods of making the same in which a window material such as boron carbide ($B_4C$) or other similar material is deposited on a substrate by chemical vapor deposition. The substrate is then etched to form a hole in alignment with the deposited window material. The substrate forms a wall of the electron tube housing, and the etched hole constitutes the window opening. VanRalte et al, U.S. Pat. No. 3,788,892 forms an opening in the wall of the housing and covers that opening with a temporary support film. The window material is then deposited in a relatively thin layer over temporary support film. The deposited window material extends beyond the periphery of the temporary support film, so that the deposited window material bonds with the housing wall. After deposition of the window material, the temporary support film is removed, dissolving the same. Another reference directed to fabrication of electron beam permeable membranes is Japanese Laid-Open Patent Publication 2-138900. U.S. Pat. Nos. 3,531,340; 5,030,318; and 4,228,815 describe fabrication of thin, membrane-like structures for other purposes.

Various attempts have been made to select structural configurations for the windows opening, of the housing and associated components so as to maximize the pressure resistance of the window. Much of this work has been directed to optimization of large area electron beam window structures, having a window area (measured in the plane of the membrane) on the order of 1 $cm^2$ or more, and typically 100 $cm^2$ or more. These large-window structures typically incorporate a supporting framework with multiple apertures and a unitary membrane extending across the various apertures. Structures of this type are described, for example, in U.S. Pat. Nos. 4,721,967; 4,333,036 and 4,591,756. A further electron beam window structure is shown in U.S. Pat. No. 3,105,916.

Despite all of this effort in the art heretofore, there have been substantial, unmet needs heretofore for improved electron tube structures equipped with electron permeable membranes; for improved methods of making such structures; and for improved components for use in fabricating such structures.

The invention of the '942 application and the present invention address these needs.

THE '942 INVENTION

My copending application, U.S. Ser. No. 08/045,942, (the "942 application") filed Apr. 12, 1993, now U.S. Pat. No. 5,391,958, discloses a method of making an electron beam tube preferably including the steps of placing a closure unit including an electron-permeable portion and a polymeric material on a surface of a wall of a hollow housing. The placing step is conducted so that the electron-permeable portion overlies a hole in the wall of the housing and so that the polymeric material is in contact with the wall of the housing. The method further includes the step of bonding the closure unit and housing to one another to thereby form an assembly so that the closure unit seals the hole and so that the closure unit is connected to the housing through the polymeric material. Additionally, the method includes the steps of baking the assembly at an elevated bakeout temperature while evacuating the interior of the housing and cooling the so-baked assembly.

The closure unit may include an electron-permeable membrane and a ring of polymeric material formed separately from the membrane. The step of placing the closure unit may include the step of placing the membrane and the ring so that the membrane overlies the hole in said wall and so that the ring surrounds the hole and lies between the membrane and the wall.

Preferably, the polymeric material has a glass transition temperature and the bakeout temperature is above the glass transition temperature of the polymeric material. The polymeric ring desirably includes or consists essentially of a polymer having appreciable strength at temperatures above its glass transition temperature and up to the bakeout temperature. Most preferably, the polymeric material consists essentially of polyimide having a glass transition temperature less than about 250° C. and the bakeout temperature is above about 300° C.

The polymeric ring serves to hold the membrane in place during the bakeout step, and serves as a permanent part of the assembly after the process is complete. However, the polymeric ring also serves to absorb any differences in thermal expansion during cooling after bakeout. At least part of the cooling involves cooling over a range above the glass transition temperature of the polymer ring. While the polymer is above its glass transition temperature, it is relatively soft and pliable and hence can accommodate some movement of the membrane relative to the housing wall, so as to compensate for differential thermal expansion of the membrane and wall materials. Thus, cooling from the bakeout temperature to the glass transition temperature of the polymeric ring does not induce appreciable stress in the membrane. The glass transition temperature is relatively close to room temperature, typically less than about 250° C., and therefore cooling from the glass transition temperature to room temperature entails only limited amounts of differential thermal expansion. Moreover, even below the glass transition temperature, the polymeric ring can deflect to some extent and hence can mitigate stresses induced by differential thermal expansion at least to some degree.

Although the polymeric ring can deflect at temperatures above its glass transition temperature, it still maintains appreciable structural strength, sufficient to keep the membrane in position during the bakeout step. Particularly when the preferred polymeric materials are employed, the structural strength of the polymeric ring is sufficient to permit application of differential pressure across the membrane during the bakeout cycle. Thus, the exterior of the tube housing may be exposed to normal atmospheric pressure whereas the interior of the tube housing is connected to a vacuum pump or other suction device through a temporary connection port in the housing. The temporary connection port is closed at the end of the bakeout cycle. This in turn permits rapid, economical handling of the assemblies during the bakeout cycle in mass production operations.

A housing component for a an electron beam tube is also provided in the '942 application. A component according to this aspect includes a front wall. The front wall has an exterior surface, an interior surface, and a hole extending from the exterior surface through the front wall to the interior surface. An electron permeable membrane overlies the hole. A ring of a polymeric material encircles the hole. The ring is interposed between the membrane and the exterior surface of the front wall. The membrane is bonded to the ring whereas the ring is bonded to the front wall so that the membrane is bonded to the front wall at least partially through the ring. In use, the front wall will bound the interior space of the housing and the hole in the front wall will constitute the window for passage of the electron beam. The component may also include the outer walls of the housing. Components according to this aspect can be used in methods as discussed above.

The membrane preferably consists essentially a material selected from the group consisting of carbides, nitrides hydrides and oxides of metals selected from the group consisting of silicon, aluminum, and boron, and combinations of these materials. Boron nitride, boron hydride and combinations thereof form one particularly useful set of materials for use in the membrane, boron nitride hydride being most preferred. The front wall may be formed from essentially any material having requisite structural strength and impermeability. It is not necessary to match the coefficient of thermal expansion of the membrane precisely. Thus, inexpensive, easy-to-work materials such as metals may be used to good advantage.

A further aspect of the '942 invention provides a component for an electron beam tube which also has a front wall. Here again, the front wall has exterior and interior surfaces and a hole extending from the exterior surface the front wall to the interior surface. An electron permeable membrane is secured to the exterior surface of the front wall so that the membrane overlies the hole, either by means of the polymeric ring structure discussed above or by other means. Here again, the front wall will serve as the front wall of the electron tube housing. Accordingly, when the component is used in an electron tube and the tube is subjected to differential pressure conditions in which the ambient pressure on the exterior surface exceeds the low subatmospheric pressure within the housing, the ambient pressure will urge the membrane inwardly, against the exterior surface and into the hole. The ambient pressure will apply stress to the membrane. In a component according to this aspect of the invention, stress relief means are provided for mitigating stress concentration in the membrane adjacent the periphery of the hole.

This aspect of the '942 invention incorporates the realization that when ambient pressure tends to urge the membrane into the hole to the interaction between the membrane and the wall at the periphery of the hole tends to create a substantial stress concentration in the membrane, and the related realization that the strength and service life of the membrane may be substantially enhanced by mitigating this stress concentration.

The hole may have a peripheral surface extending generally parallel to the axis of the hole and generally transverse to the exterior surface of the front wall. The stress relief means may include a juncture surface merging with the peripheral surface and with the exterior surface of the front wall, the juncture surface flaring outwardly away from the axis of the whole so as to provide a gradual transition between the exterior surface of the front wall and the peripheral surface of the hole. Thus, the juncture surface may define a radius between the exterior surface and the peripheral surface.

The stress relief means is particularly beneficial where the electron permeable membrane is a material housing relatively high elastic modulus, such as the carbides, nitrides and hydrides discussed above. Also, although the features discussed above may be utilized with components having holes of different sizes, they are particularly valuable where the hole is less than about 5 mm, and especially less than about 1 mm in diameter, and where the membrane is less than about 3 micrometers thick. Although the invention not limited by any theory of operation, it is believed that relief of the stress concentration at the periphery of the hole is particularly important for components of this configuration.

Yet another aspect of the '942 invention includes electron tubes incorporating components according to aspects of the invention discussed above.

SUMMARY OF THE PRESENT INVENTION

The present invention provides a method of making a beam tube whereby a closure unit, including a beam-permeable membrane and a ring of polymeric material formed separately from the membrane, is placed on an exterior surface of a front wall of a hollow housing defiing an interior therein so that the beam-permeable membrane overlies a hole formed in the hollow housing and so the polymeric ring is between the membrane and front wall. The front wall includes means for retaining the ring of polymeric material in a predetermined location on the exterior surface of the front wall of the housing and away from the hole during the bonding step. The bonding step includes bonding the closure unit and the housing to one another to thereby form an assembly so that the closure unit is connected to the housing through the polymeric material with the retaining means retaining the polymeric material away from the hole during the bonding step. The means for retaining can comprise an annular channel formed in the exterior surface of the front wall of the housing with the ring of polymeric material being at least partially retained in the annular channel. The step of placing the polymeric ring can further include the step of placing a liquid polymer precursor in the annular channel so that the precursor lies between the exterior surface and the membrane, with the bonding step including the step of heating the membrane, precursor and housing to an elevated bonding temperature to cure the polymer precursor and form the polymeric ring disposed at least partially in the annular channel while bonding the ring to the membrane and exterior surface. Preferably, the annular channel has a maximum depth beneath the exterior surface of the front wall of 100 microns or less, and preferably about 50 microns.

In accordance with another aspect of the invention, the means for retaining can comprise an annular raised inner ridge formed on the exterior surface of the front wall of the housing so as to encircle the hole and be encircled by the polymeric ring to retain the polymeric ring in a predetermined position with respect to the hole. In this manner, a liquid polymer precursor can be placed on the exterior surface of the front wall so as to encircle and surround the inner raised ridge such that in the bonding step, the membrane, precursor and housing are heated to an elevated bonding temperature to cure the polymeric precursor and form the polymeric ring while bonding the ring to the membrane and the front wall. Preferably, the raised inner ridge has a maximum height above the exterior surface of the front wall of 100 microns or less, and more preferably, about 50 microns. An additional raised outer ridge can also be formed on the exterior surface of the front wall so as to encircle the inner ridge and define an annular track therebetween on the exterior surface to retain the polymeric ring. Thus, the liquid polymer precursor can then be placed in the annular track for bonding as described above.

A further aspect of the invention provides that the means for containing comprises a flow preventing ring disposed on the exterior surface of the front wall of the housing and between the polymeric ring and the hole. In this aspect, liquid polymer precursor may be placed on the exterior surface of the front wall of the housing so as to encircle and surround the flow preventing ring, with the bonding step including the step of heating the membrane, precursor and housing so as to cure the polymeric precursor and form the polymeric ring while bonding the ring to the membrane and the front wall. Preferably, the flow preventing ring is formed by coating a portion of the exterior surface of the front wall with a diamond layer having a preferred thickness of about 5 microns or less.

The present invention also provides a forward housing for a beam tube. Although the present invention has been described herein as relating to electron beam tubes, the beam tube can also be provided for use with electromagnetic radiation emitting sources, such as X-rays. The beam tube is provided with a front wall with an exterior surface, an interior surface and a hole extending inwardly from the exterior surface through the front wall to the interior surface. The front wall further includes means for retaining the ring of polymeric material in a predetermined location on the exterior surface and away from the hole during bonding. As described above, the means for retaining may include an annular channel; an annular raised inner ridge alone or in combination with an annular raised outer ridge to form an annular track therebetween; or a ring of flow preventing material or several of these structures.

The housing may further include a beam-permeable membrane overlying the exterior surface and covering the hole, and a ring of polymeric material interposed between the membrane and the exterior surface of the front wall.

These and other objects, features and advantages of the present invention will be more readily apparent from the detailed description of the preferred embodiments set forth below, taken in conjunction with the accompany drawings.

DETAILED DESCRIPTION OF THE EMBODIMENTS

Figure 1:
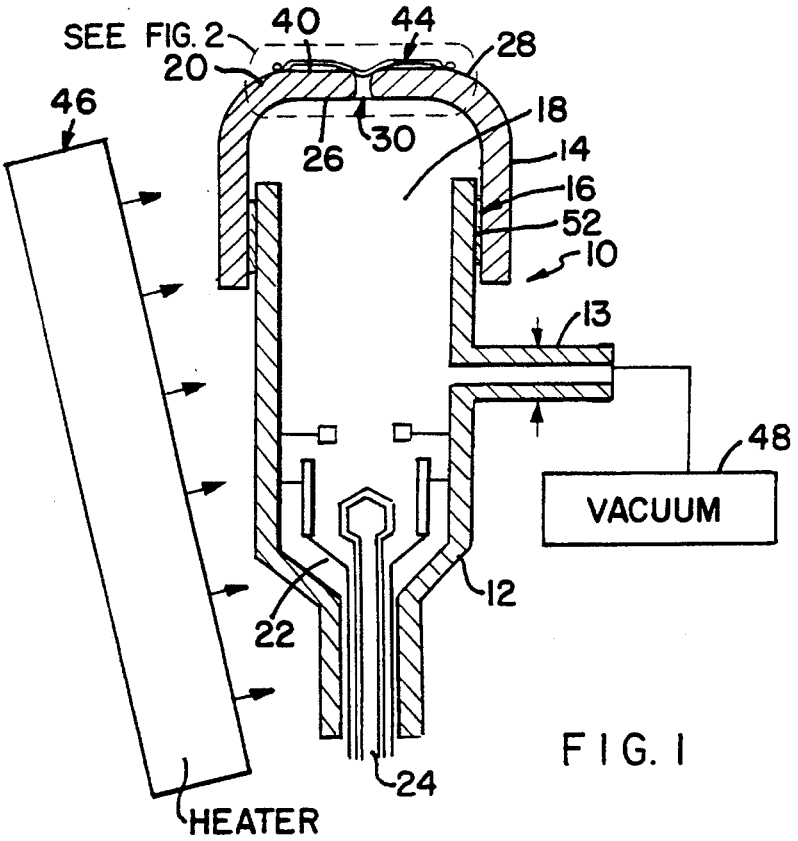
FIG. 1 is a diagrammatic sectional view depicting an electron tube in accordance with one embodiment of the invention disclosed in the '942 application during a stage in the process also disclosed therein.

A tube in accordance with one embodiment disclosed in the '942 application incorporates a hollow housing 10. Housing 10 incorporates a rear envelope portion 12 formed from a dielectric material, preferably a glass such as a borosilicate, soda lime or lead oxide glass of the type commonly used for fabrication of electron tube envelopes and for so-called "lamp working" processes in the glass industry. Rear portion 12 is generally in the form of a cylindrical tube. A hollow tubular temporary port portion 13 projects from the cylindrical rear portion.

The housing 10 further includes a front or forward portion 14 formed from a metal. Forward portion 14 and rear portion 12 are sealingly bonded together as schematically indicated at 16 so that the forward and rear portion cooperatively enclose an interior space 18. Forward portion 14 defines a front wall 20.

Conventional electron beam generating, accelerating and focussing components schematically indicated at 22 are disposed inside housing 10. These components are electrically connected to leads 24. Leads 24 extend out of housing 10 through the wall of rear portion 12 at the read end of the housing, remote from front wall 20. The leads are provided with glass-to-metal seals of the type commonly employed in vacuum tube technology.

Figure 2:
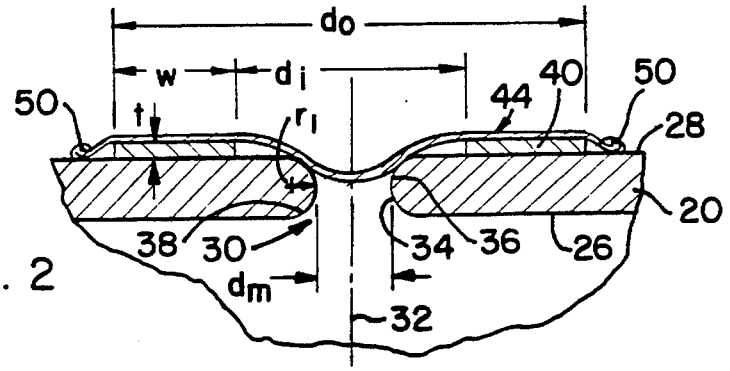
FIG. 2 is a diagrammatic, idealized sectional view depicting a portion of the tube shown in FIG. 1.

Front wall 20 has an interior surface 26 facing towards the interior 18 of the housing and an oppositely facing, exterior surface 28 facing away from the housing. A hole 30 extends through front wall 20, from exterior surface 28 to interior surface 26. As best seen in FIG. 2, hole 30 has an axis 32 and a peripheral surface 34 which, in this instance, is generally in the form of a surface of revolution about axis 32. As the peripheral surface extends from the interior side of the wall 20, adjacent interior surface 26 towards exterior surface 28, the peripheral surface extends generally in the direction of axis 32 and generally in a direction transverse to the plane of exterior surface 28. Front wall 20 further defines a juncture surface 36 merging with peripheral surface 34 and with front surface 28. Juncture surface 36 is a surface of revolution about hole axis 32. The generator of juncture surface 36, is itself a curve with a radius of curvature $r_1$. As further discussed hereinbelow, the generator may have either a constant or varying radius of curvature. Juncture surface 36 flares outwardly, away from hole 30 and away from axis 32 so that juncture surface 36 provides a smooth, gradual transition between front wall surface 28 and peripheral surface 34. Not only does this smooth, gradual transition provide mechanical stress relief as herein described, but it also provides electromagnetic stress relief by avoiding the presence of sharp edges or corners which would otherwise allow development an unwanted electrostatic charge concentration. In the particular arrangement illustrated, wall 20 also defines an interior transition surface 38 flaring outwardly, away from hole 30 and away from axis 32 at the juncture between peripheral surface 34 and interior surface 26.

Hole 30 does not have a uniform diameter throughout its entire extent, but instead has a minimum diameter at a point along axis 32 about midway between surfaces 26 and 28. As used in this disclosure with reference to a hole or aperture of non-uniform diameter, the term "minimum transverse dimension" should be taken as referring to the diameter of the largest rigid sphere which could pass unimpeded through every portion of the hole. Where the peripheral wall bounding the hole is substantially in the form of a surface of revolution about an axis, such as with hole 30, the minimum transverse dimension is simply the minimum diameter of such surface of revolution at any point along its axis. The desired minimum transverse dimension or diameter will depend, to some extent, on the application in which the electron group is to be utilized. For many applications, transverse dimensions less than about 10 mm, particularly less than about 5 mm, and most preferably about 1 mm can be employed. Such dimensions can be employed, for example, in electron tubes for many fluid atomization processes according to my aforementioned U.S. Patent and International Publication.

Hole 30 may be formed in front wall 20 by conventional machining processes or, more preferably, by etching. For example, a conventional etching process in which the front wall is masked and then exposed to an etching solution can be employed. Combinations of such processes can also be used. For example, the hole can be formed by a machining process such as drilling, laser ablation, or the like, and the flaring juncture surface 36 and interior transition surface 38 may be formed by exposing the front wall, with the formed hole to an etchant so that the etchant dissolves material from the front wall. Similarly, these surfaces can be formed by electro-polishing, i.e., by reverse electroplating in which the front wall serves as the cathode and metal is removed. Other conventional metalworking processes can also be used to form the hole and the juncture surface.

A polymeric ring 40 overlies the exterior surface 28 of front wall 20 and encircles hole 30 and juncture surface 36. As illustrated, ring 40 is a thin, generally sheetlike annulus having a thickness, measured in the direction transverse to exterior surface 28, many times less than the dimensions of the ring in directions parallel to surface 28. The thickness t of ring 40 preferably is between about 0.1 μ and about 10 μ, more desirably between about 0.1 μ and 3.0 μ, and most desirably between about 0.5 μ and 1.0 μ. The interior dimensions of ring 40 desirably are just slightly larger than the dimensions of juncture surface 36. That is, the innermost edge of ring 40 should lie just outboard of the location where the juncture surface 36 merges into exterior surface 28. The width W of ring 40, i.e., the distance between the interior edge of the ring adjacent to hole 30 and the exterior edge of the ring remote from the hole, measured parallel to exterior surface 28 of wall 20 desirably is at least about 0.05 mm, and more preferably between about 0.2 and about 4 mm. Where hole 30 and juncture surface 36 are in the form of surfaces of revolution about axis 32, ring 40 can be a circular annulus having an interior diameter di and exterior diameter do. For example, di may be about 1.0 mm to about 3.0 mm, whereas do may be about 5.0 mm to about 7.0 mm.

Ring 40 is formed from a polymeric material. As further discussed hereinbelow, the material of ring 40 should be capable of bonding to the material of front wall 20, and also to the electron-permeable membrane incorporated in the apparatus. Further, the material of ring 40 desirably has a glass transition temperature below the bakeout temperature to be used in forming the election tube. The glass transition temperature desirably is as low as possible but above the maximum temperature which the ring will reach during storage and/or service of the tube after manufacture. The material of ring 40 should have substantial strength above its glass transition temperature to withstand the process discussed hereinbelow and when heated during bakeout will tend not to form a liquid but will rather have a gummy consistency. Ring 40 may include, or consist essentially of, polymers selected from the group consisting of polyimides and epoxy.

Polyimides are particularly preferred. An especially preferred polyimides is that sold under the designation EL-5010 by National Starch, Inc. of 10 Finderne Ave., Bridgewater, N.J. The EL-5010 material has a glass transition temperature of about 230° C. Ring 40 may be formed by die-cutting from a preformed sheet of the desired polymeric material. Alternatively, ring 40 may be formed in situ by depositing the polymeric materials from solution or suspension, by polymerization in situ or by conventional plastics processing techniques such as powder coating or spin coating, as further described below.

A thin, electron-permeable membrane 44 overlies ring 40 and the exterior surface 28 of wall 20. Membrane 44 covers wall 30 and juncture surface 36, and extends outwardly, away from the hole beyond the outer periphery of ring 40. Membrane 40 desirably is formed from a material of high strength and relatively low atomic number. The preferred materials generally have elastic modulus greater than about $10^{12}$ dynes/cm$^2$. Preferred materials include compounds of carbon and nitrogen and hydrogen with metals such as Si, Al and B. Thus, the carbides, nitrides, hydrides and oxides of these metals may be employed. Combinations including mixed compounds such as nitride hydrides, nitride carbides and carbide hydrides may also be employed. SiC, BN, $B_4C$, $Si_3N_4$, $Al_4C_3$, $Al_2O_3$ and other compounds may be employed. A particularly preferred compound, however, is boron nitride hydride or $B_4NH$. Desirably, membrane 40 is less than about 3 micrometers thick. The lower limit of membrane thickness is set by the need to provide a pinhole-free, substantially impermeable membrane and to provide sufficient structural strength to enable the membrane to withstand stresses encountered in service. Preferably, the membrane is between about 20 nm and about 3 micrometers thick. Membranes between about 0.1 and 1 micrometers thick are more preferred. Suitable membranes can be formed by chemical vapor deposition on a temporary substrate which is then removed from the membrane, as by etching after the membrane is formed. Also, suitable membranes are commercially available from suppliers including Kevex, division of Fisons, Inc., Valencia, Calif.

In an assembly process, the front portion 14 and rear portion 12 of the housing are united with one another, and the electronic components 22 are disposed in the interior space 18 enclosed by the front and rear housing portions. Then, a coating of a polymer precursor in liquid form is applied on the exterior surface 28 of the front wall 20 of front housing portion 14 so that the coating occupies a ring-like region having the same configuration as the desired polymeric ring 40. Thus, the ring-like liquid coating region surrounds hole 30. The liquid coating can be applied by any suitable coating process such as brushing, roller-coating, silk screen coating or the like. Spin coating is particularly preferred. In a spin coating process, the liquid precursor is applied to the front surface 28, and then front wall 20 is rotated rapidly about axis 32 so as to spread the liquid over the front wall. After spreading the liquid, the membrane 44 is placed over the liquid coating. The front surface of the wall, the surface of the membrane or both may be cleaned and/or subjected to other surface treatments to promote adhesion. Merely by way of example, where the polymeric material includes a polyimide, the surfaces may be pretreated with a solution in methanol and water of a so-called "adhesion promoter" available from the aforementioned National Starch Company under the designation "AP-20".

The assembly is subjected to conditions which cure the liquid precursor and form polymeric ring 40. This curing step also causes the polymeric ring to bond to membrane 44 and to the exterior surface 28 of the wall. Normally, the curing operation involves heating the assemblage of the membrane, liquid coating and front housing portion, typically while maintaining it under atmospheric pressure, The precise heating steps used to cure the liquid precursor will vary with the composition of the precursor used. However, for the preferred polyimide materials, the steps used to cure the membrane typically involve heating to about 250–350 degrees C.°, followed by gradual cooling to about room temperature. The membrane 44 and polymeric ring 40 cooperatively constitute a closure unit which seals hole 30. With the membrane bonded in place by the polymeric ring, the entire assemblage is subjected to heat, as from a heater 46 (FIG. 1) while maintaining the interior space 18 of the housing in communication with a vacuum source 48 such as a conventional vacuum pump and cold trap assemblage, so as to draw out volatile materials from the interior of housing 10, and from electronic parts 20. As illustrated, communication between the interior of the housing and vacuum source 48 is maintained through temporary port 13. Preferably, the temporary port is connected to the vacuum source but the exterior of housing 10 is maintained under normal, atmospheric conditions. Thus, there is no need to conduct the bakeout procedure inside of a vacuum oven. The assembly is heated to a preselected bakeout temperature sufficient to promote relatively rapid evaporation of volatile residues within the assembly. Desirably, the bakeout temperature is between about 250° and about 450° C., and more desirably, about 350° to about 450° C. The elevated bakeout temperature is maintained for a time sufficient to allow the volatile substances in the assembly to pass out through temporary port 13 to vacuum source 48, typically about 1 hour or more. After sufficient time has elapsed, temporary port 13 is closed by momentarily heating the glass wall of housing portion 12 at the temporary port and deforming the wall to close the port. Because the ring 40 has substantial structural strength even above its glass transition temperature, it holds membrane 44 in place during the bakeout step. The polymeric ring is effective to maintain the membrane in place as well as to exclude the surrounding atmosphere despite the substantial pressure differential between the atmosphere and the low, sub-atmospheric pressure in the interior space 18 of housing 10.

After the bakeout step, the assemblage is cooled, typically to room temperature, or to another convenient handling temperature below the glass transition temperature of the polymer in ring 40. While the assemblage is cooling through the range between the bake-out temperature and the glass transition temperature of the polymer in the ring, the polymer of the ring can deform and can allow movement of membrane 44 relative to front surface 28 to an extent sufficient to compensate for differences in thermal expansion between membrane 44 and front wall 20. After cooling, an auxiliary sealing material 50 may be applied around the periphery of membrane 44 so as to further seal the membrane to wall 20 and provide an even more reliable seal against entry of foreign substances into interior space 18. Although ring 40 provides a good seal against entry of the atmosphere or other foreign materials into the interior space, the ring need not be the sole barrier to 20 long-term permeability if the auxiliary sealing material is employed. Among appropriate auxiliary sealing materials which can be used to good advantage are epoxy and urethane.

During the bake-out process, and in service as well, membrane 44 is subjected to differential pressure which tends to urge it inwardly, into hole 30. Thus, the pressure of the atmosphere, or the pressure of any surrounding fluid will tend to force the membrane into the hole. As schematically depicted in FIG. 2, the membrane tends to bow inwardly, into hole 30, and hence is forced against front wall 20, so that the inwardly directed forces on the membrane are transmitted between the membrane and the front wall. Juncture surface 36 permits such force transmission while maintaining reasonable levels of stress in those portions of the membrane contacting the wall. Thus, because juncture surface 36 flares outwardly in a gradual manner, a substantial region of membrane 44 can contact wall 20. By contrast, if hole 30 were provided with a sharp, knife edge at its intersection with exterior surface 28, membrane 44 could contact wall 20 only along a very narrow region at the knife edge. Moreover, the flaring juncture surface 36 allows the membrane to bend into engagement with the wall without substantial wrinkling or distortion. Both of these factors tend to reduce the stress in membrane 44 particularly at its juncture with wall 20. Thus, a given membrane can withstand a substantially greater pressure than would otherwise be the case. Also, resistance of the membrane to fluctuating stresses, such as may be encountered where the external ambient pressure fluctuates, is greatly enhanced. The reduced stress materially reduces the tendency of the membrane material to fatigue under the influence of the fluctuating stress.

The degree of stress reduction achieved by juncture surface 36 will vary with the precise configuration of the juncture surface. Some stress reduction can be achieved by a juncture surface having an arbitrary, constant radius of curvature $r_1$. Such a constant-radius juncture surface corresponds to the surface generated by revolving a segment of a circle with radius r1 about axis 32. Preferably, the generator of juncture surface 36 is a segment of an ellipse having its major axis parallel to front surface 28 and its minor axis parallel to the axis 32 of the hole. Thus, the radius of curvature $r_1$ of the juncture surface increases progressively along the juncture surface in the direction away from the central axis 32 of the hole. Stated another way, the radius of curvature of the juncture surface increases progressively from the point where the juncture surface merges with the peripheral wall of the hole to the point where the juncture surface merges with front wall 28. The generating curve of the juncture surface need not be an ellipse or a circle, but instead may have an arbitrary shape calculated to provide the minimum stress in the membrane. Such calculations can be performed using stress analysis computer programs by assuming a uniform pressure load on the outer surface of membrane 44 and taking into account the local deflection of the front wall 20 under contact loads transmitted from the membrane, as well as friction between the membrane and the juncture surface. By calculating of the maximum local stress in the membrane for a particular juncture surface generating curve, varying the curve and recalculating the stress repetitively, conventional computer techniques for iterative calculation can be used to find the optimum generating curve for the juncture surface 36.

In use, electronic components 22 are employed to produce an electron beam and to focus that beam so that the same passes through hole 30 in forward wall 20. The beam passes through that portion of membrane 44 overlying the hole. The electron tube can be used for various applications where emission of an electron beam outside of the tube is required. A preferred use, however, is in dispersion and atomization of fluent materials.

In the method discussed above, the forward portion 14 and rear portion 12 of housing 10 are sealed and bonded to one another before assembly of the membranes and polymeric ring to the forward portion 14 of the housing. Such sealing may incorporate a conventional glass-to-metal seal of the type commonly utilized in the electron tube and lamp arts. Alternatively, the steps of uniting the front and rear housing portions 12 and 14 and sealing the same together, and introducing the electronic components and sealing the same in place may be performed after bonding the membrane in place. The seal 16 may incorporate a hoop or gasket 52 formed from a polymeric material similar to that discussed above with reference to ring 40. Again, the polymeric material, at temperatures above its glass transition temperature but below the bakeout temperature used in the fabrication process is flexible but yet has appreciable mechanical strength. Where such a hoop is employed, the forward portion 14 and rearward portion 12 of the housing 10 can be bonded to one another by bonding processes similar to those discussed above. Thus, a liquid precursor material as discussed above is placed between the forward portion 14 and rearward portion 12 of the housing in the region to be occupied by hoop 52. Thus, the liquid precursor may be coated onto one or both housing portions before the housing portions are united with one another. Alternatively, the precursor may be introduced by capillary action into the space between the housing portions while the same are held in their assembled position. The liquid precursor is cured to form hoop 52 in the same way as the precursor is cured to form membrane 44, thereby bonding the housing portions to one another. This may be done before or after membrane 44 is bonded to the front wall 20 of the forward portion 14. Preferably, however, both bonding steps are performed simultaneously. Thus, the membrane can be positioned on the front wall, and the forward portion can be positioned on the rearward portion with the polymeric precursor in place to form the membrane 44 and polymeric hoop 52 as illustrated. The entire assemblage can be heated to promote curing and bonding. The heating step used in the aforementioned bonding operations may occur as the assemblage is taken from room temperature to the elevated bake-out temperature. Preferably, application of vacuum to the interior of the housing is delayed until after the bonding steps are complete, i.e., until after the polymeric materials have been cured to solid, coherent condition.

Polymeric hoop 52 permits appreciable relative movement between the adjacent surfaces of forward portion 14 and rearward portion 12, and thus compensates for differential thermal expansion and contraction occurring at temperatures above the glass transition temperature of the polymeric material used in the hoop. Here again, because the glass transition temperature is relatively close to room temperature, only moderate stress will be induced by differential thermal expansion or contraction of forward portion 14 and rearward portion 12 over the range between the glass transition temperature and room temperature, even where there is a substantial difference in thermal coefficient of expansion between these two portions. There is, accordingly, no need to provide precise matching between the coefficients of thermal expansion. Where this approach is employed, forward portion 14 may be fabricated from a relatively inexpensive metal such as ordinary steel, stainless steel, copper, aluminum or other metal. Where a conventional glass-to-metal seal is employed, the formed portion 14 of the housing desirably is formed from a material which has a coefficient of expansion close to that of the rearward portion.

Figure 3:
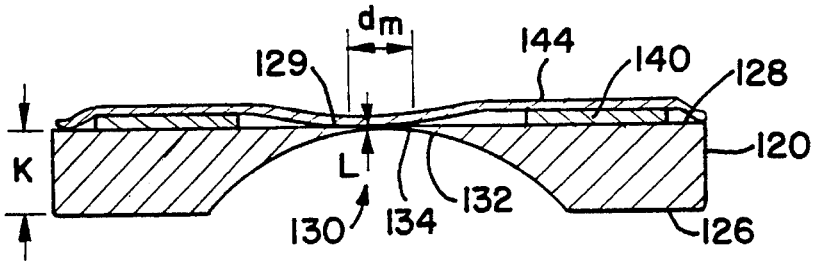
FIG. 3 is a diagrammatic sectional view similar to FIG. 2 but depicting portions of a tube in accordance with a further embodiment disclosed in the '942 application.

Apparatus according to a further embodiment of the '942 application is partially depicted in FIG. 3. This apparatus includes a forward portion having a front wall 120 with an interior surface 126 and exterior surface 128. Here again, a polymeric ring 140 is provided between membrane 144 and the exterior surface 128 of front wall 120, and the membrane covers a hole 130 extending through front wall 120.

Front wall 120 has a preselected wall thickness K in regions remote from hole 130 and tapers to a substantially smaller wall thickness L in a region 132 immediately surrounding hole 130. Region 132, having this lesser wall thickness, is substantially flexible. Flexible region 132 has an exterior surface 129 which is flush with the other portions of exterior surface 128, whereas the inwardly facing surface of flexible region 132 (the surface of region 132 facing downwardly in FIG. 3) is substantially recessed from the interior surface 126 of the wall. In use, and during the aforementioned evacuation and bakeout steps, flexible region 132 can deflect inwardly so as to conform with membrane 144 when membrane 144 is forced inwardly, into hole 130 by differential pressure. Flexible region 132 desirably merges gradually into the remainder of wall 120. That is, there is no sharp transition in thickness between flexible region 132 and the remainder of the wall, but instead, a gradual, progressive increase in thickness from the edge 134 immediately adjacent hole 130 to the rest of wall 120. At edge 134, flexible wall portion 132 may have essentially zero thickness. This configuration can be formed by conventional machining processes. Alternatively, it can be fabricated by etching from wall 120 using an etchant applied to the interior surface 126 of the front wall. Preferably, the interior surface is covered by a masking material with a hole of approximately the same size as the desired hole minimum diameter or minimum transverse dimension $d_m$. The etchant will progressively remove material starting at the interior surface and form the tapering wall configuration shown. In other respects, the structure, operation and fabrication process are the same as those discussed above with reference to FIGS. 1 and 2.

Figure 4:
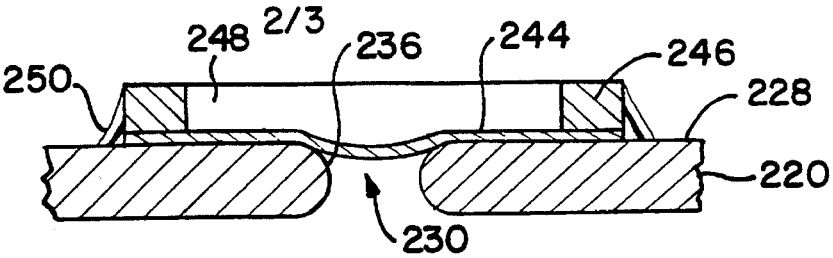
FIG. 4 is a diagrammatic sectional view similar to FIGS. 2 and 3 but depicting portions of a tube in accordance with yet another embodiment disclosed in the '942 application.

Apparatus according to a further embodiment of the '942 application is partially depicted in FIG. 4. This apparatus includes a forward component having a front wall 220 with a hole 230. Hole 230 is provided with an outwardly flaring juncture surface 236 similar to the juncture surface discussed above with reference to FIG. 2. However, membrane 244 is not attached to front wall 220 by means of a deformable polymeric ring. Instead, membrane 244 is bonded to a substantially rigid ring 246. Ring 246 may be composed of silicon, a metallic material or a polymer. Preferably, membrane 244 is formed by chemical vapor deposition on a solid part (not shown) which is then etched to form an opening 248, and thereby form ring 246. Membrane 244 becomes bonded to the solid part during the chemical vapor deposition process, and remains attached to the ring when the ring is formed by etching. Ring 246 is secured to the exterior surface 228 of front wall 220 by application of a bonding materials 250 such as silver solder, polyimide or epoxy, around the periphery of the ring and membrane prior to the bakeout procedure. This arrangement is less preferred inasmuch as it does not provide for relief of differential thermal expansion and contraction between ring 246 and membrane 244 during the bakeout procedure. However, it does provide the benefits of stress relief afforded by outwardly flaring juncture surface 236.

A fabrication process and apparatus in accordance with a further embodiment of the '942 application is depicted in FIGS. 5A–5D. In a first stage of this fabrication process, the front wall 320 is machined or etched as discussed above with reference to FIG. 2 to form a hole 330 with the outwardly flaring juncture surface 236. A temporary, filler material 331 with a low melting temperature is then placed into hole 330. The exterior surface 328 of front wall 320, and the filler material 331 are polished to form a smooth, continuous, flush surface. A layer 333 of a high temperature bonding material such as silver (FIG. 5B) is applied on this flush surface. A membrane 344 is then applied by vapor deposition atop layer 333. Membrane 344 bonds to layer 333 during the deposition step. A peripheral portion of membrane 344 may also bond directly to the exterior surface 328 of front wall 320. Temporary filler material 331 is then removed, as by heating, leaving the assemblage in the configuration illustrated in FIG. 5C. In this configuration, high temperature bonding material 333 covers the central portion of membrane 344, in alignment with hole 330.

Figure 5A:
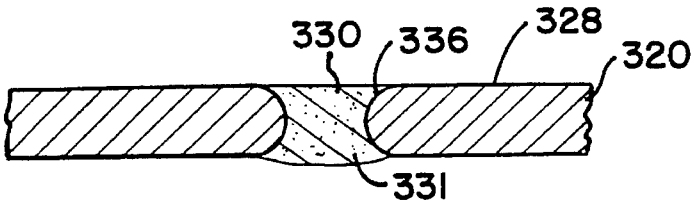
FIGS. 5A through 5D are diagrammatic sectional views similar to FIGS. 2–4 but depicting portions of a tube according to yet another embodiment disclosed in the '942 application.
Figure 5B:
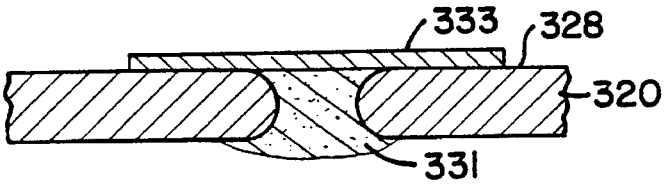
Figure 5C:
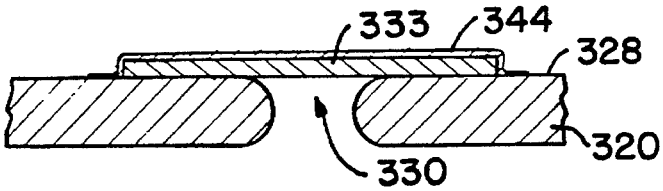
Figure 5D:
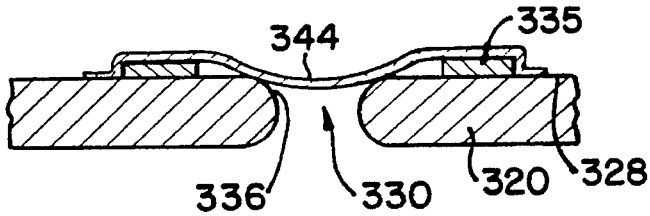

The assemblage is then exposed to an etchant solution applied from the interior surface 326 of wall 320. The etchant is selected so that it attacks bonding material 333 but does not substantially attack the materials of wall 320 or membrane 344. The etchant passes through hole 330 and attacks the portion of bonding material layer 333 aligned with the hole and with outwardly flaring juncture surface 336. The etchant thus progressively removes portions of layer 333, working from the center of hole 330 outwardly. After sufficient time has elapsed, the etching process is interrupted, leaving the assemblage in the condition illustrated in FIG. 5D. Thus, a ring-like structure 335 is formed from layer 333, so that membrane 344 is connected to wall 320 through ring-like structure 335 adjacent the periphery of the membrane and remote from hole 330. However, those portions of exterior surface 328 disposed adjacent hole 330, inside ring 335 are free of bonding material. Juncture surface 336 is also free of bonding material. Thus, when membrane 344 is forced inwardly by differential pressure during service, as schematically indicated in FIG. 5*d*, it can bear on the juncture surface 336.

Where layer 333 and ring-like structure 335 are formed from a metallic material or other material which remains substantially rigid at all temperatures for the bakeout procedure, it does not provide compensation for differential thermal expansion or contraction in the same manner as discussed above with reference to FIGS. 1–3. However, layer 333 and ring-like structure 335 can be formed from a polymeric material as discussed above with reference to ring 40, to provide compensation for differential thermal expansion. Thus, polyimides and other common polymers can be etched in the production scheme contemplated by FIGS. 5A–5D.

A tube according to another embodiment of the '942 application has a forward housing portion defining a front wall 420 (FIG. 6) with a hole 430 and juncture surface 436 similar to the corresponding components discussed above. The closure unit overlying and sealing hole 430 includes a polymeric sheet 433 bonded to the exterior surface 428 of the front wall, and an additional electron-permeable, gas-impermeable membrane 444 overlying the polymeric sheet and bonded to the front wall through the polymeric sheet. The electron-permeable, gas-impermeable membrane 444 may be similar to the membrane 44 discussed above with reference to FIGS. 1 and 2. Polymeric sheet 433 acts to absorb differences in thermal expansion between electron-permeable membrane 444 and front wall 420. This action is substantially the same as the action of polymeric ring 40 (FIGS. 1 and 2). However, the polymeric sheet of FIG. 6 also extends across hole 430. Accordingly, the polymeric sheet 433 should be thin enough that it does not substantially impede passage of the electron beam. With the preferred polyimide materials, the membrane should be substantially less than about 0.5 mm (500 micrometers) thick.

Figure 6:
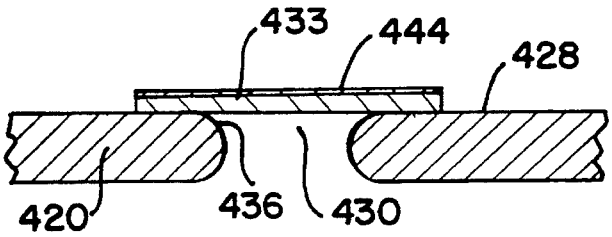
FIG. 6 is a view similar to FIG. 2 but depicting portions of a tube according to a further embodiment disclosed in the '942 application.

Structures as illustrated in FIG. 6 may be fabricated by bonding a separately-formed sheet of polymer to the front wall, and then applying the electron-permeable membrane 444 on the polymer sheet. The electron-permeable membrane may be formed by chemical vapor deposition on the polymeric sheet. Alternatively, the polymeric sheet may be formed in situ from liquid polymer on the exterior surface of the front wall by use of a temporary filler material similar to that discussed above with reference to FIG. 5B. The temporary filler material is removed after curing the polymeric sheet.

Numerous other variations and combinations of the features discussed above can be utilized. Merely, by way of example, a front wall having a deformable, flexible region as illustrated in FIG. 3 can be utilized to provide stress relief at the periphery of the hole in the structures of FIGS. 4 and 5. Also, other means for mitigating stress concentration in the membrane adjacent the periphery of the hole may be employed. For example, a separate cushioning or load distributing body, in the form of a relatively small ring of a springlike, compressible material, can be interposed between the membrane and the front wall at the periphery of the hole. Such a cushioning structure can be formed integrally with the polymeric ring used to take up thermal expansion. In yet another variant, the membrane can be formed integrally with the polymeric ring. Thus, the closure unit used to seal the hole in the front wall may include a unitary sheet of an electron-permeable polymeric material similar to the polymeric membrane 433 discussed above with reference to FIG. 6, but without the additional membrane 444. That polymeric sheet may be placed over the hole in the front wall and the periphery of the sheet may be bonded to the wall by heating in the manner discussed above. This variant relies solely on the polymeric sheet to seal the hole, and requires that the polymeric sheet be electron-permeable. Thus, the polymeric sheet constitutes both the polymeric material and the electron-permeable portion in the closure unit. A polyimide sheet about 0.5 mm thick generally provides sufficient mechanical strength and electron permeability. However, the polyimide sheet allows gradual permeation of air into the housing and therefore is suitable for use as an electron-permeable membrane only for a relatively short-lived electron tube.

Also, although the outwardly flaring juncture surfaces 36 discussed above with reference to FIG. 2 are generally in the form of a surface of revolution generated by rotation of a curved generator line about the axis of the hole, similar results can be approximated by a juncture surface defined by one or more conical portions. Where a plurality of conical portions are included, the same may include a conical portion of relatively small included angle merging with the peripheral surface of the hole and another conical portion of larger included angle extending from the first conical portion to a juncture with the exterior surface of the front wall. Greater numbers of conical portions of progressively increasing included angle may be provided. Although the embodiments discussed above employ holes of circular cross-section, with peripheral and juncture surfaces in the form of surfaces of revolution about an axis, other embodiments may include holes of non-circular cross-section. For example, the hole in the front wall may be in the form of an elongated slot. In this case, the juncture surface would flare outwardly at each edge of the slot.

Figure 7:
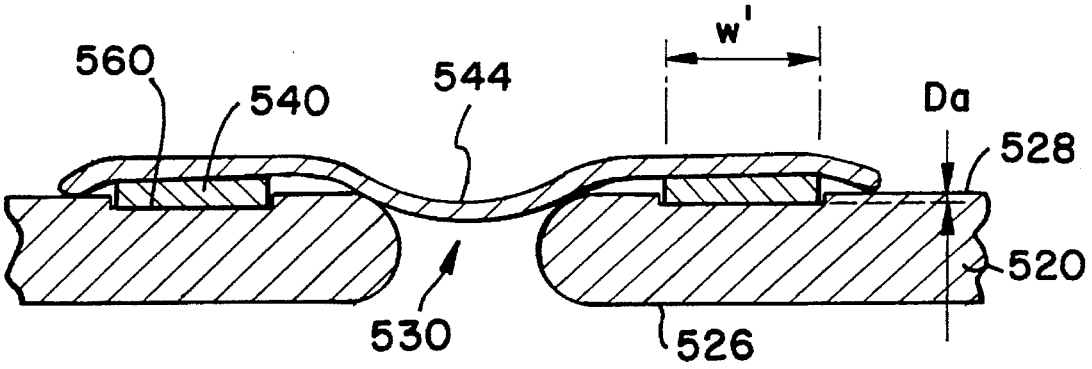
FIG. 7 is a diagrammatic sectional view similar to FIGS. 2–4, but depicting portions of a tube in accordance with one embodiment of the present invention.

Referring now to FIG. 7, a beam tube according to one aspect of the present invention has a forward housing portion defining a front wall 520 with an interior surface 526 and an exterior surface 528. Provided on exterior surface 528 and extending into front wall 520 is an annular channel 560 extending circumferentially around hole 530 extending through front wall 520. A polymeric ring 540 is disposed between beam-permeable membrane 544 and exterior surface 528 of front wall 520. Polymeric ring 540 is also disposed in annular channel 560 and partially retained therein so as to keep polymeric ring 540 in a fixed or predetermined position with respect to hole 530. Annular channel 560 has a predetermined maximum depth $D_a$ beneath exterior surface 528 of preferably about 100 microns or less, and more preferably, about 50 microns.

Annular channel 560 also has a width W', i.e., the distance between the interior edge of the channel adjacent to hole 530 and the exterior edge of the channel remote from the hole, measured parallel to exterior surface 528 of wall 520, desirably at least about 0.05 mm, and more preferably between about 0.2 and 4 mm.

In a method of forming the beam tube in accordance with the present invention, polymeric ring 540 is formed by the step of placing a liquid polymer precursor in annular channel 560 and between exterior surface 528 and membrane 544. The bonding step is then carried out and includes the step of heating membrane 544, the precursor, and housing portion to an elevated bonding temperature so as to cure the polymer precursor and form polymeric ring 540 disposed at least partially in annular channel 560 while bonding polymeric ring 540 to membrane 544 and exterior surface 528 of front wall 520. In particular, the polymer bonds to the surfaces of annular channel 560. The formation of annular channel 560 in front wall 520 is a highly advantageous feature when forming polymeric ring 540 from a liquid polymer precursor as it functions to retain the polymeric material away from hole 530, thus preventing any unwanted migration of the polymeric material towards and into hole 530 or other unwanted areas on exterior surface 528 during the bonding process.

Figure 8:
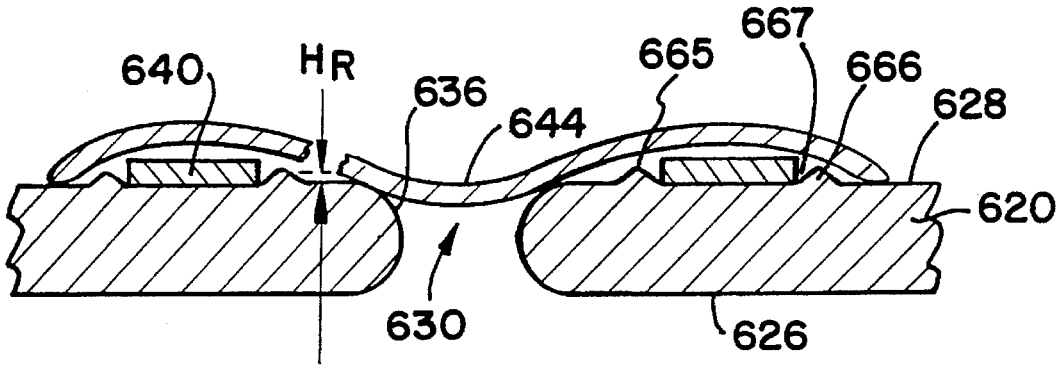
FIG. 8 is a diagrammatic sectional view similar to FIGS. 2–4 and 7 but depicting portions of a tube in accordance with another embodiment of the present invention.

According to another embodiment of the present invention, FIG. 8 shows a forward housing portion defining a front wall 620 with an interior surface 626 and an exterior surface 628. Provided on exterior surface 628 is an annular raised inner ridge 665 extending circumferentially around hole 630 which extends through front wall 620. A polymeric ring 640 encircles inner ridge 665 so that inner ridge 665 retains polymeric ring 640 in a predetermined position with respect to hole 630 and, in particular, keeps the polymeric material away from the hole. Raised inner ridge 665 has a predetermined maximum height $H_R$ above exterior surface 628 of front wall 620 of about 50 microns or less, and preferably about 40 microns. Preferably, inner ridge 665 is at a distance far enough away from hole 630 so as to retain polymeric ring 640 and at the same time not otherwise interfere with the stress-relieving regions adjacent hole 630. However, the radially inward side of inner ridge 665 may also be formed with a gentle downward slope so that the inward side of the ring blends gradually into the outwardly flowing juncture surface 636 immediately surrounding hole 630 so as to assist in providing stress relief at the periphery of hole 630.

In the embodiment illustrated, an annular raised outer ridge 666 is also formed on exterior surface 628 of front wall 620 so as to encircle inner ridge 665 and define an annular track 667 therebetween. Annular raised outer ridge 666 also has a preferred maximum height above exterior surface 628 of about 50 microns or less and preferably about 40 microns, and preferably has a gentle sloping geometry so as not to introduce any additional stresses to membrane 644. Annular track 667 also functions to retain polymeric ring 640 therein as is with the case of annular channel 560 as shown in FIG. 7. That is, the inner and outer ridges 665 and 666 cooperatively constrain the polymer in a manner similar to the walls of channel 560 (FIG. 7).

In a method of forming the beam tube where only raised inner ridge 665 is provided, polymeric ring 640 can be formed by placing a liquid polymer precursor on exterior surface 628 of front wall 620 so as to encircle and surround inner raised ridge 665. In the bonding step, the membrane 644, precursor and housing are heated to an elevated bonding temperature so as to cure the polymer precursor and form polymeric ring 640 while bonding the ring to membrane 644 and exterior surface 628 of front wall 620.

Figure 9:
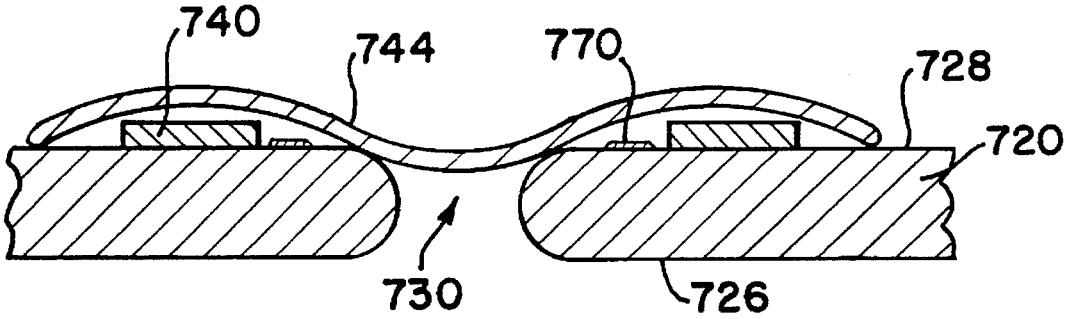
FIG. 9 is a diagrammatic sectional view similar to FIGS. 2–4 and 7–8 but depicting portions of a tube in accordance with a yet further embodiment of the present invention.

Referring to FIG. 9, a tube according to yet another aspect of the present invention has a forward housing portion defining a front wall 720 with an interior surface 726 and an exterior surface 728. Provided on exterior surface 728 is a ring of flow preventing material 770 extending circumferentially around the periphery of hole 730. Polymeric ring 740 is disposed between membrane 744 and surrounds flow preventing ring 770 in a manner similar to the surrounding of inner ridge 665 (FIG. 8).

In a method of forming the beam tube, polymeric ring 740 is formed by placing a liquid polymer precursor on exterior surface 728 so as to encircle and surround flow preventing ring 770. In the bonding step, membrane 744, the precursor and the housing are heated to an elevated bonding temperature so as to cure the polymer precursor and form polymeric ring 740 while bonding the polymeric ring to membrane 744 and exterior surface 728. In this manner, flow preventing ring acts as a non-wetting barrier such that the polymeric material will remain in a predetermined area on exterior surface 728 and not migrate towards hole 730. Flow preventing ring 770 may be formed from any substance which will not be wet by the polymer at the elevated bonding temperature and which is otherwise innocuous in the electron tube environment. Thus, the non-wetting substance should not "outgass" or emit volatile substances. Silicon and diamond films are suitable. Thus, the ring can be formed by coating a portion of exterior surface 728 of front wall 720 with a diamond layer or silicon layer of a few microns thick, preferably 5 microns or less. This may be accomplished through known techniques in the art, such as chemical vapor deposition, sputtering, etc.

Numerous other variations and combinations of the features discussed previously with respect to retaining the polymeric ring can be utilized. For example, flow preventing ring 770 may also be provided on the exterior surfaces 528 and 628 of the embodiments shown in FIGS. 7 and 8, and a second outer flow preventing ring could be utilized similar to outer ridge 666 in FIG. 8. Furthermore, although the present invention is preferably used with electron beam tubes as described in my '942 application, it may also be used with other beam tube applications such as X-ray beam tubes.

As these and other variations and combinations of the features described above can be utilized without departing from the present invention, the foregoing description of the preferred embodiments should be taken by way of illustration rather than by way of limitation of the present invention as defined by the claims.

I claim:

1. A method of making a beam tube comprising the steps of:

(a) placing a closure unit, including a beam-permeable membrane and a ring of polymeric material formed separately from said membrane, on an exterior surface of a front wall of a hollow housing defining an interior therein so that said beam-permeable membrane overlies a hole formed in said hollow housing and so that said polymeric ring is between said membrane and said front wall, said front wall including means for retaining said ring of polymeric material in a predetermined location on said exterior surface, said step of placing said closure unit including the step of placing said membrane and said polymeric ring so that said membrane overlies said hole and said polymeric ring surrounds said hole; and (b) bonding said closure unit and said housing to one another to thereby form an assembly so that said closure unit is connected to said housing through said polymeric material, said retaining means retaining said polymeric material away from said hole during said bonding step.

2. A method as claimed in claim 1, further comprising the steps of baking said assembly at an elevated bakeout temperature while evacuating said interior of said housing and cooling the baked assembly.

3. A method as claimed in claim 1, wherein said means for retaining comprises an annular channel formed in said exterior surface of said front wall of said housing, said ring of polymeric material being at least partially retained in said annular channel.

4. A method as claimed in claim 3, wherein said step of placing said polymeric ring includes the step of placing a liquid polymer precursor in said annular channel so that said precursor lies between said exterior surface and said membrane, said bonding step including the step of heating said membrane, precursor and housing to an elevated bonding temperature so as to cure said polymer precursor and form said polymeric ring disposed at least partially in said annular channel while bonding said polymeric ring to said membrane and said exterior surface.

5. A method as claimed in claim 3, wherein said annular channel has a maximum depth beneath said exterior surface of said front wall of 100 microns or less.

6. A method as claimed in claim 1, wherein said means for retaining comprises an annular raised inner ridge formed on said exterior surface of said front wall of said housing, said inner ridge encircling said hole and being encircled by said polymeric ring so as to retain said polymeric ring in a predetermined position with respect to said hole.

7. A method as claimed in claim 6, wherein said step of placing said polymeric ring includes the step of placing a liquid polymer precursor on said exterior surface of said front wall of said housing so as to encircle and surround said inner raised ridge, said bonding step including the step of heating said membrane, precursor and housing to an elevated bonding temperature so as to cure said polymer precursor and form said polymeric ring while bonding said polymeric ring to said membrane and said front wall.

8. A method as claimed in claim 6, wherein said raised inner ridge has a maximum height above said exterior surface of said front wall of 100 microns or less.

9. A method as claimed in claim 6, wherein said means for retaining further comprises an annular raised outer ridge formed on said exterior surface of said front wall of said housing so as to encircle said inner ridge and define an annular track therebetween on said exterior surface to retain said polymeric ring.

10. A method as claimed in claim 8, wherein said step of placing said polymeric ring includes the step of placing a liquid polymer precursor on said exterior surface of said front wall of said housing and in said annular track, said bonding step including the step of heating said membrane, precursor and housing to an elevated bonding temperature so as to cure said polymer precursor and form said polymeric ring while bonding said polymeric ring to said membrane and said front wall.

11. A method as claimed in claim 1, wherein said means for retaining comprises a ring of flow preventing material disposed on said exterior surface of said front wall of said housing between said polymeric ring and said hole.

12. A method as claimed in claim 11, wherein said step of placing said polymeric ring includes the step of placing a liquid polymer precursor on said exterior surface of said front wall of said housing so as to encircle and surround said flow preventing ring, said bonding step including the step of heating said membrane, precursor and housing to an elevated bonding temperature so as to cure said polymer precursor and form said polymeric ring while bonding said polymeric ring to said membrane and said front wall.

13. A method as claimed in claim 11, further comprising the step of forming said flow preventing ring by coating a portion of said exterior surface of said front wall with a diamond layer having a thickness of about 5 microns or less.

* * * * *